United States Patent [19]

Rudolf

[11] Patent Number: 4,895,356

[45] Date of Patent: Jan. 23, 1990

[54] FOLDER

[75] Inventor: Stäb Rudolf, Frankenthal, Fed. Rep. of Germany

[73] Assignee: Albert-Frankenthal AG, Frankenthal, Fed. Rep. of Germany

[21] Appl. No.: 219,788

[22] Filed: Jul. 18, 1988

[30] Foreign Application Priority Data

Aug. 7, 1987 [DE] Fed. Rep. of Germany ..... 3726239

[51] Int. Cl.[4] ..... B42C 1/04

[52] U.S. Cl. ..... 270/49; 270/21.1

[58] Field of Search ..... 270/4–6, 270/21.1, 45, 47, 48, 49, 50, 51, 60; 493/424, 425, 356, 359–360

[56] References Cited

U.S. PATENT DOCUMENTS

| | | | |
|---|---|---|---|
| 2,022,688 | 12/1935 | Quick | 270/48 |
| 4,147,337 | 4/1979 | Bolkza-Schünemann | 270/48 |
| 4,211,396 | 7/1980 | Michalik | 270/47 |
| 4,519,597 | 5/1985 | DeSanto | 270/21.1 |

FOREIGN PATENT DOCUMENTS

| | | | |
|---|---|---|---|
| 3030705 | 2/1982 | Fed. Rep. of Germany | 270/21.1 |

*Primary Examiner*—Robert E. Garrett
*Assistant Examiner*—Therese M. Newholm
*Attorney, Agent, or Firm*—Collard, Roe & Galgano

[57] ABSTRACT

In the context of a folder for the production of products having at least one transverse fold and a cut parallel to the transverse fold, comprising a transverse cutting means, at least one transverse folding means and at least one smooth cut means made up of (a) scissors cut knives mounted on a folding cylinder which is provided with folding jaws (which cooperate with the tucker blades of a collect cylinder) in the part between the folding jaws and (b) at least one mating scissors cut knife set towards the peripheral part of the folding cylinder moving from the collect cylinder, the invention seeks to provide for simple resetting of the smooth cut and the possibility of stopping the production of smooth cuts during operation. In order to make this possible the folding cylinder consists of at least two coaxial fitting carriers, which are able to be turned in relation to each other and are driven at the same speed, and furthermore are fitted with folding jaws and, respectively scissors cut knives, and with coaxial drive wheels, which are coupled with each other by way of an adjustable bridge drive in a driving manner, the drive wheel of the one fitting carrier mounting the scissor cut knives engages a drive wheel of the knife cylinder and the drive wheel of the fitting carrier mounting the folding jaws is in engagement with a drive wheel associated with the tucker blades of the collect cylinder.

16 Claims, 3 Drawing Sheets

54
1
30
37
5
40
46
47
15
44
41
45
42
22
43
4
35
21
34
26
13
41
25
46
12
45
24
44
42
43
39
3
33
27
23
32
28
7
2
31
36
29
38

FOLDER

BACKGROUND OF THE INVENTION

The invention relates to a folder for the production of products having at least one transverse fold and a cut parallel to the transverse fold, comprising a transverse cutting means, at least one transverse folding means and at least one smooth cut means made up of (a) scissors cut knives mounted on a folding cylinder which is provided with folding jaws (which cooperate with the tucker blades of a collect cylinder) in the part between the folding jaws and (b) at least one mating scissors cut knife set on the peripheral part of the folding cylinder moving from the collect cylinder.

A folder of this type has been proposed in the German unexamined patent specification 3,303,705. In the case of this known arrangement the scissors knives are arranged at a fixed distance from the folding jaws and may therefore not be adjusted. The engagement of the scissors cut knives therefore always takes place at the same distance from the folding jaws. However in many cases there is a necessity to modify this distance, for example in order to carry out regulation. A further requirement in this respect is the avoidance, as far as possible, of loss production owing to the plant having to be shut down.

SHORT SUMMARY OF THE INVENTION

Accordingly taking this state of the art as starting point one object of the present invention is devise a folder of the initially mentioned type which avoids the shortcomings of known devices and in particular is so improved that the distance of the scissors knife engagement from the folding jaws may be adjusted during operation.

In order to attain these or other objects appearing from the present specification and claims, the folding cylinder consists of at least two coaxial fitting carriers, which are able to be turned in relation to each other and are driven at the same speed, and furthermore are fitted with folding jaws and, respectively scissors cut knives, and with coaxial drive wheels, which are coupled with each other by way of an adjustable bridge drive in a driving manner, the drive wheel of the one fitting carrier mounting the scissor cut knives engages a drive wheel of the knife cylinder and the drive wheel of the fitting carrier mounting the folding jaws is in engagement with a drive wheel associated with the tucker blades of the collect cylinder.

The bridge drive provided in this case ensures a positive driving coupling of the drive wheel pair associated with the fitting carriers for the folding jaws and the scissors cut knives so that during normal operation there is practically a semirigid connection and thus precise synchronism of the fitting carriers forming the folding cylinder. At the same time it is possible to ensure that by suitable setting of the elements of the bridge drive there is a corresponding oppositely-directly adjustment of the respective fitting carriers. Respective operation of the bridge drive may thus take place while the folder is running so that it is not necessary to halt the plant, something that would involve various disadvantages such as the production of spoiled impressions. A further factor is that regulation of the smooth cut able to be performed during operation also makes simple checking possible. The advantages to be obtained with the invention are thus more especially highly economic operation and great simplicity thereof.

In the invention the bridging drive may in a simple form thereof have two helical pinions able to be adjusted in the axial direction and adapted to mesh with two helically toothed drive wheels. In accordance with another design of the invention the two pinions may be linked together by means of differential drive, this making possible an adjustment in the peripheral direction so that there is a large range of adjustment. In this respect it is therefore advantageously possible not only to regulate the smooth cut but also to put the smooth cut means out of operation by moving the scissors cut knives so far from the folding jaws that the mutual engagement of the scissors cut knives and the mating scissors cut knives takes place beyond the trailing sheet end of the folded product.

It is an advantage if the bridge drive has a shaft parallel to the shafts of the associated drive wheels and having the pinions turningly mounted on it which are in mesh with the associated drive wheels, such pinions being drivingly connected with each other by means of a harmonic drive which has two internal rigid gear rings, each respectively connected with one of the pinions, and which are in mesh with a common, externally toothed elastic ring, into which there is fitted an elliptical collar mounted on the shaft for the pinions, which is able to be adjusted by means of setting device in the direction of rotation. These measures will be seen to lead to a particularly simple and compact manner of construction. At the same time, owing to the high transmission ratio of the harmonic drive there is a possibility of extremely fine adjustment.

In order to compensate for the difference in speed between the two internally toothed rings of the harmonic drive it is possible for one of the drive wheels simply to have two toothed rings with different diameters, of which one is engagement with the associated pinion and the other is in mesh with an associated drive wheel of an adjacent cylinder.

In accordance with a further advantageous feature of the invention the setting means associated with the shaft of the bridge drive may have a servo motor. This feature involves the advantage of remote control. In accordance with a further development of the invention the setting means may at the same time be provided with an indicating device so as to increase the simplicity of operation thereof.

Further advantageous developments and convenient improvements of the invention will be gathered from the ensuring detailed account of one working example of the invention as shown in the drawings.

LIST OF THE SEVERAL VIEWS OF THE FIGURES

DETAILED ACCOUNT OF WORKING EXAMPLE OF THE INVENTION

Figure 1:
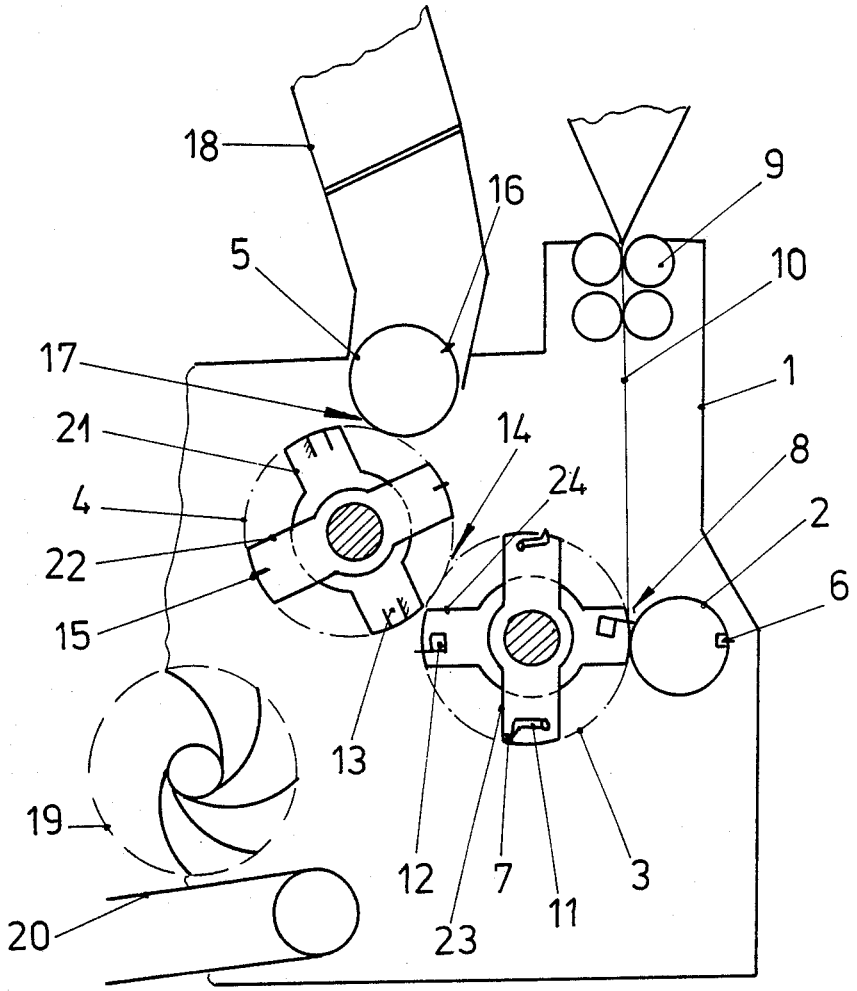
FIG. 1 is a diagrammatic side view of a folder in accordance with the invention.

The structure and workings of a folder being well known, no full, detailed description thereof is needed in what follows. The folder shown in FIG. 1 consists of two cylinders, placed between two side walls 1, in the form of a cutting cylinder 2, a collect cylinder 3 engaging it, a folding cylinder 4 cooperating with the latter and a knife cylinder cooperating with the folding cylinder 4. The cutting cylinder 2 is provided with a knife box 6. The collect cylinder 3 has cutting grooves 7 associated with the knife box 6. The knife box 6 and the cutting grooves 7 operate as a transverse cutting device 8, by which a web 10 of paper drawn in by traction rolls 9 into the folder is cut up into sheet products. The cutting grooves 7 of the collect cylinder 3 are associated with pins 11 which grip the start of the paper web cut afresh each time a transverse severing action takes place. In the part between the pins 11 the collect cylinder 2 is equipped with tucker blades 12. The folding cylinder 4 possesses folding jaws 13 associated with the tucker blades 12, and these jaws 13 cooperate with the tucker blades 12 in the form of a transverse folding device 14. In the part between the folding jaws 13 the folding cylinder 4 is equipped with scissors cut knives 15. The knife cylinder 5 possesses a mating scissors action knife 16, which cooperates with the scissors action knives 15 of the folding cylinder 4 in order to form a smooth cut means 17, by which the trailing edge of the products received in the folding jaws 13 may be severed using a smooth or scissors cut. This makes it possible to remove the edges with the holes made by the pins 11. These paper strips cut off by the smooth cut means are sucked off by a suction device 18 associated with the knife cylinder 5.

With the aid of the folder shown it is thus possible to produce cross-folded products having a smooth cut margin at the trailing edge. The finished products are deposited in a fan wheel 19 placed under the folding cylinder 4 and then placed by it on an underlying delivery belt 20.

In order to able to regulate the distance of the smooth cut performed by the smooth cut means 17 from the respective preceding folding jaw 18, the folding cylinder 4 has, as may be furthermore seen from FIG. 1, two coaxial, separately rotatable fitting carriers 21 and 22, of which the fitting carrier 21 mounts the folding jaws 13 and the fitting carrier 22 carries the scissor action knives 15. The fitting carriers 21 and 22 are able to be driven at the same speed so that there is an even rotation of the entire cylinder 4. In the event of adjustment of the fitting carrier 22 with the scissors action knife cylinder 15 being desired the knife cylinder 5 is adjusted in the same manner.

In the illustrated working example of the invention the collect cylinder 3 as well is made up of two coaxial fitting carriers 23 and 34, respectively, able to be turned in relation to each other and of which the fitting carrier 23 has the cutting grooves 7 and the pins 11 and the fitting carrier 24 bears the tucker blades 12. By suitable mutual adjustment of the fitting carriers 23 and 24 is possible to regulate or adjust the position of the cross-fold produced by the transverse folding device 14. In a corresponding manner together with the fitting carrier 24 having the tucker blades 12 of the collect cylinder 3 at the same time the fitting carrier 21, having the folding jaws 13, of the folding cylinder 4 is adjusted and vice versa. The cutting cylinder 2 is adjusted with the fitting carrier 23 containing the cutting grooves 7.

Figure 2:
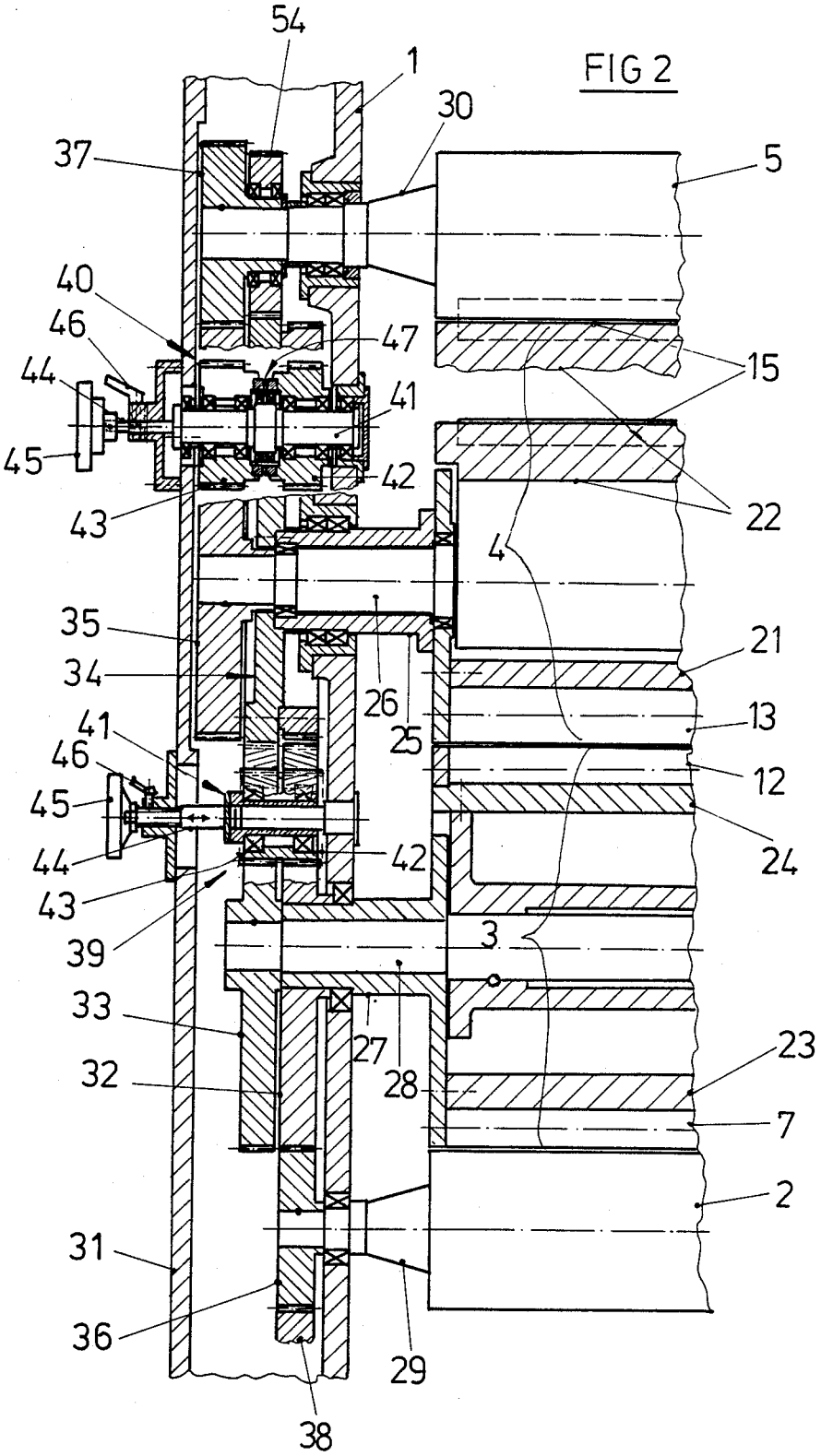
FIG. 2 shows a preferred working example of a train of driving wheels associated with the cylinders of the folder shown in FIG. 1.

The cylinders or the fitting carriers forming them have lateral journals by which they are supported on the side walls 1 of the machine, as will best be seen from FIG. 2. The journals of the folding cylinder 4 are in the form of hollow shafts 25 fixed to the end plates of the fitting carrier 21 with the folding jaws 13, and internal shafts 26 which are secured to the fitting carrier 22 for the scissors action knives 15 fit into these hollow shafts 25. The internal shafts 26 are bearinged on the hollow shafts 25 and the latter are bearinged on the side wall 1. Adjacent to the collect cylinder 3 the fitting carrier 23 with the pins 7 is provided in a similar manner with lateral hollow shafts 27, which receive internal shafts 28 fixed to the fitting carrier 24 for the tucker blades 12. The journals 29 and 30 of the cutting cylinder 2 and of the knife cylinder 5 are in the form of plain pins bearinged in the side walls 1.

The drive of the cylinders is by way of a drive wheel train arranged adjacent to one side wall. This drive chain is accommodated in a gear box 31 attached to the side wall 1 viewed in FIG. 2 and consists of drive gears screwed and keyed, respectively, on the ends of the journals projecting into the gear box 31. The collect cylinder 3 formed by the two fitting carriers 23 and 24 is provided with two corresponding adjacent coaxial drive wheels 32 and 33, of which the inner one, that is to say the drive wheel 32 adjacent to the side wall 1 is keyed on the end, projecting into the gear box 31, of the hollow shaft 27 and the outer drive wheel 33 is keyed onto the end, extending out of the hollow shaft 27, of the inner shaft 28. In a similar manner the two-part folding cylinder 4 has two coaxially arranged drive wheels 34 and 35, respectively, of which the inner drive wheel 34 is mounted on the hollow shaft 25 of the fitting carrier 21 with the folding jaws 13 and the drive wheel 35 is mounted on the end, projecting from the hollow shaft 25, of the inner shaft 26 of the fitting carrier 22 with the scissors action knives 15. The cutting cylinder 2 and knife cylinder 5 are each provided with a drive wheel 36 and, respectively, 37. The drive torque is supplied via a drive element indicated at 38 to the drive wheel 36 associated with the cutting cylinder 2 and owing to the toothed engagement of the drive wheels associated with the adjacent cylinders in the form of train of gear wheels such torque is suppled through to the drive wheel 37 of the knife cylinder 5. The drive wheel 36 of the cutting cylinder 2 in this respect in mesh with the drive wheel 32 associated with the cutting grooves 7 and the pins 11. From the wheel 32 the torque is conducted to the adjacent drive wheel 33 associated with the tucker blades 12, such wheel 33 being in mesh with the drive wheel 34 associated with the folding jaws 13. From the wheel 34 the torque is transmitted to the adjacent drive wheel 35 associated with the scissors action knives 15 and meshing with the drive wheel 37 of the knife cylinder 5. This ensures that on resetting the cutting or folding means of one cylinder the cutting and folding means of another cylinder cooperating therewith are automatically reset as well.

The coaxially adjacent drive wheels 32 and 33 and in the other case 34 and 35 of the fitting carriers of the collect cylinder 3 and of the folding cylinder 4, respectively, are so coupled with each other during normal operation by associated bridge drive 39 and 40, respectively, that there is a more or less rigid connection therebetween and thus complete synchronism. The bridge drive 39 drivingly connecting the drive wheels 32 and 33 of the collect cylinder 3 comprises, as will be also seen from FIG. 2, two pinions 42 and 43, respectively, bearinged on a shaft 41 bearinged in the frame so as to be parallel to the shaft of the associated drive wheels 32 and 33, such pinions being rigidly connected with each other (in the present case they are integral). The pinions 42 and 43 are in mesh with a respective one of the drive wheels 32 and 33 so that there is a transmission of the torque. The pinions 42 and 43 and the associated drive wheels 32 and 33 are helically toothed so that axial displacement of the pinions 42 and 43 is accompanied by a rotary motion of the drive wheels 32 and 33. The pinions 42 and 43 are accordingly made broader by an amount equal to the amount of axial adjustment than the drive wheels 32 and 33 so that in the terminal settings as well there is a sufficiently broad zone of tooth mesh. The pinions 42 and 43 arranged adjacent to each other are, in the illustrated form of the invention, like the associated drive wheels 32 and 33, provided with helical teeth of opposite hand so that there is a doubling of the possible angle of turn. In order to bring about the axial reset of the pinions 42 and 43 the shaft 41 is adjusted in position and for this purpose in the illustrated working embodiment of the invention the shaft has a bushing accommodating the pinions 42 and 43 and mounted on a pin which is fixed to the housing. This bushing is provided with a drive stub shaft 44 which extends through the gear box and has a rear part in the form of a threaded pin fitting into a threaded sleeve on the housing. At its end it has a handwheel 45. In order to lock the arrangement in the desired setting there is a tommy screw 46 which cooperates with the drive stub shaft 44 and fits into a radial hole in the threaded sleeve.

The bridge drive 40 provided for drivingly coupling the drive wheels 34 and 35 of the folding cylinder 4 may be designed in the same manner as the above described bridge drive 39. In the illustrated working example of the invention the bridge drive 40, see FIG. 2, also has two pinions 42 and 43 also bearinged on a shaft 41 arranged parallel to the shaft of the associated drive wheels 34 and 35. These pinions 42 and 43 are in the present case drivingly connected together by means of a differential drive in the form of a harmonic drive 47. This use of a differential drive makes possible a practically unlimited relative twisting of the pinions 42 and 43. This makes it possible to so increase the distance between the scissors action knives 15 from the folding jaws 13 that the scissors action knives 15 and the mating scissors action knives 16 (which owing to the meshing engagement between the drive wheels 35 and 37 are automatically adjusted as well) only come into mutual engagement to the rear of the trailing edge of the folded product taken up in the preceding folding jaws, this practically amounting to the putting of the smooth cut means 17 out of operation. No removal of the knives or a halting of the knife cylinder 5 is thus needed to put the smooth cut means 17 out of operation.

Figure 3:
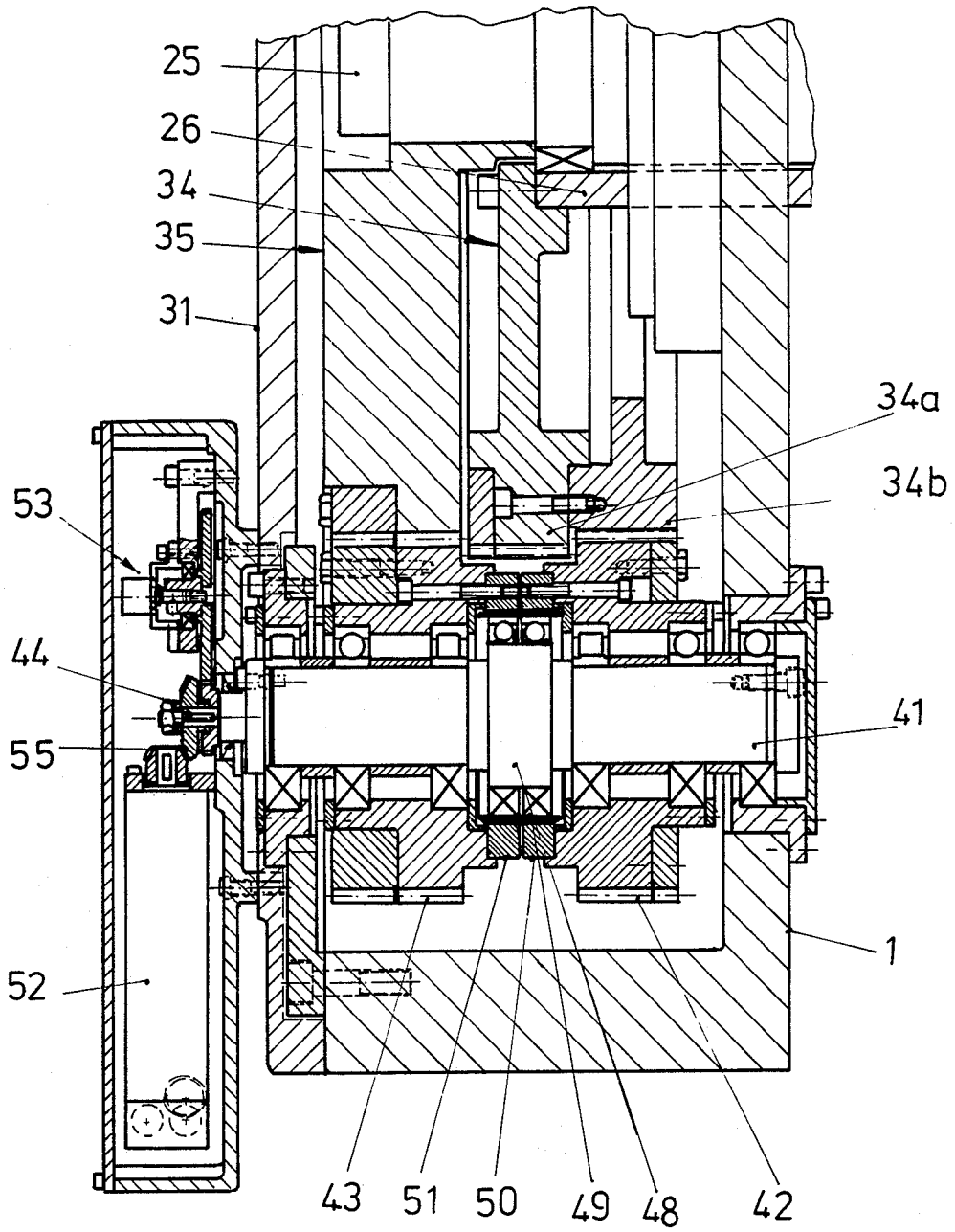
FIG. 3 is a section taken through the drive wheels of the bridge drive associated with the folding cylinder fitted with the folding jaws and the scissors cut knives.

In order to ensure a compact construction the differential drive 47 is in the form of a harmonic drive, as has already been indicated; and it is best to be seen from FIG. 3. In order to form the harmonic drive the shaft 41 mounting the pinions 42 and 43 is provided with an elliptical collar 48 between the two pinions and this collar has an elastic externally geared ring 49 bearinged thereon, which is in engagement with two internally toothed, rigid rings 50 and, respectively, 51, which are attached to the mutually facing end sides of the adjacently placed pinions 42 and 43. By turning the shaft and thus the elliptical collar 48 a relative rotation of the rigid rings 50 and 51 and thus of the pinions 42 and 43 rigidly connected therewith and of the drive wheels 34 and 35 meshing therewith is produced. The shaft 41 is bearinged in the side wall 1 or the box wall parallel thereto in order to make such a rotary motion possible. And it is provided with a drive stub shaft 44 projecting out of the gear box 31. As indicated in FIG. 2, this shaft 44 may be provided with a handwheel 45, there furthermore being a tommy screw 46 if desired. On the other hand in the case of the embodiment of the invention shown in FIG. 3 there is a servo motor 52 for causing rotation of the shaft 41. In order to produce a compact arrangement the servo motor is arrange so that its median longitudinal axis is perpendicular to the median longitudinal axis of the shaft 41. Accordingly a bevel gear wheel is keyed on the drive stub shaft 44 so that it is in mesh with a bevel gear wheel keyed on the motor shaft. The servo motor 52 may be remotely controlled from an operating console. For further simplification of operation in the example of the invention illustrated in FIG. 3 there is an indicating device 53 to show the distance set between the scissors action knives 15 and the respective folding jaw 13 ahead thereof. In the illustrated example of the invention the indicating device 53 has a drive wheel in mesh with a pinion arranged on the drive stub shaft 44, such drive wheel making it possible either to reset a pointer with a scale or an electrical sensing device, as for instance one in the form of a variable capacitor may be used.

The externally toothed, elastic ring 49 and the internally toothed rigid rings 50 and 51 of the harmonic drive have different numbers of teeth, this meaning that on transmission of the torque from the one pinion 42 to the adjacent pinion 43 the pinions 42 and 43 are turned through different angles. This may be compensated by having different pinion diameters. In the illustrated embodiment of the invention the pinions 42 and 43 have the same diameter in order to simplify the design. The correction or compensation is thus ensured by having different acting diameters of the drive wheels 34 and 35. In the present example the drive wheel 34 is for this purpose provided with two adjacently located toothed rings **34*a* and 34*b* with different diameters. The toothed ring 34*a* adjacent to the drive wheel 35 and having the larger diameter which adjacent to the bridging drive fits with play between the pinions 42 and 43 with the necessary clearance, in this case is in mesh with the drive wheel 33 of the folding blade fitting carrier of the collect cylinder 3. The toothed ring 34*b* in the form of an internally mounted ring, and having the lesser diameter, meshes with the associated pinion 42. The diameter of the toothed ring 34*b* accordingly equals the diameter of the drive wheel 35 meshing with the other pinion 43. The difference in the numbers of teeth of the toothed rings 34*a* and 34*b* is equal to twice the difference between the numbers of teeth of the elastic ring 49 and of the rigid rings 50 and 51 so that there is a full compensation or correction, that is to say there is a completely synchronous rotation of the fitting carriers 21 and 22** of the folding cylinder.

The drive wheel 33 associated with the folding blade fitting carrier 24 of the collect cylinder 3 is arranged outside the adjacent drive wheel 32. Within the toothed ring **34*a* in mesh with this drive wheel 33, of the drive wheel 34 there is thus sufficient space for the second toothed ring 34*b*, which. as we have already seen, may be simply designed as a laterally mounted ring. At the same time there is such a distance between the pinions 42 and 43 as to make possible the accommodation of the intermediate harmonic drive 47. The rigid rings 50 and 51 of the harmonic drive are connected by axis-parallel screws with the respectively associated pinion 42 and 43. In order to simplify this screw connection the pinions 42 and 43 are made in two parts, the result being a base element fixedly joined to the associated ring 50 or 51, respectively, and an added element having the hub extending through it and being on the side opposite to the ring 50 and 51**, respectively. The result is that even on using prefabricated elements it is possible to produce the desired overall tooth breadths in a simple manner.

The drive wheel 37 cooperating with the external drive wheel 35 associated with the scissors cut knife fitting cylinder 22, of the knife cylinder 5 is spaced from the side wall by the same amount as the drive wheel 35, fitting being the drive wheel 34, from the side wall 1. Thus within the drive wheel 37 (see FIG. 2) there is sufficient space for an intermediate wheel 54, which may be freely bearinged on the hub of the drive wheel 37 and in the present example meshes with the larger toothed ring 34*a* of the drive wheel 34. The drive of subsequent parts, as for instance the drive of a belt guiding means, may be taken in an uncomplicated manner from the intermediate wheel 54, such subsequent elements to be driven including, for instance, a belt guide for the folding cylinder etc.

I claim:

1. A folder for the production of products having at least one transverse fold and a cut parallel to the transverse fold, comprising a transverse cutting means, at least one transverse folding means and at least one smooth cut means made up of (a) scissors cut knives mounted on a folding cylinder which is provided with spaced apart folding jaws which are adapted to cooperate with the tucker blades of a collect cylinder, which knives are disposed in the part between the folding jaws and (b) at least one mating scissors cut knife set on the peripheral part of the folding cylinder moving from the collect cylinder and the folding cylinder consists of at least two coaxial fitting carriers, which are able to be turned in relation to each other and are driven at the same speed, and furthermore are fitted with folding jaws and, respectively scissors cut knives, and with coaxial drive wheels, which are coupled with each other by way of an adjustable bridge drive in a driving manner, the drive wheel of the one fitting carrier mounting the scissor cut knives engages a drive wheel of the knife cylinder and the drive wheel of the fitting carrier mounting the folding jaws is in engagement with a drive wheel associated with the tucker blades of the collect cylinder, and wherein the drive wheels coupled with each other by the bridge drive are arranged adjacent to each other and are connected respectively with a shaft, one of such shafts being in the form of a hollow shaft having the other shaft extending internally through it, said bridge drive having an adjustable shaft mounted parallel to the shafts of the drive wheels and two drivingly connected pinions in mesh with the drive wheels are mounted on the adjustable shaft.

2. The folder as claimed in claim 1 wherein the bridge drive includes a differential drive.

3. The folder as claimed in claim 2 wherein the pinions are bearinged separately from each other on the adjustable shaft and are coupled with each other by transmission in the form of a harmonic drive, such harmonic drive comprising two internally toothed rings each respectively connected with a common externally toothed elastic ring, into which there extends an elliptical collar mounted on a further shaft mounting the said pinions, said further shaft being able to be adjusted in the direction of rotation by a setting means.

4. The folder as claimed in claim 3 wherein one of the drive wheels comprises two toothed rings with different diameters and of which one is in mesh with the associated drive wheel on the collect cylinder and the other is in mesh with one pinion of the bridge drive, the difference in speed due to the difference in the diameters of the toothed rings corresponding to the difference in speed between the two internally toothed rings of the harmonic drive.

5. The folder as claimed in claim 4 wherein the toothed ring with the smaller diameter corresponding to the diameter of the other drive wheel is in mesh with the pinion and the toothed ring having the greater diameter is in mesh with the drive wheel joined with the collect cylinder.

6. The folder as claimed in claim 1 wherein the shaft mounting the pinions is rotatably supported on a side wall of the folder and a box wall of a gear box mounted on such wall and is provided with a stub drive shaft extending through such box wall, such stub shaft having a setting wheel of the adjusting device mounted thereon.

7. The folder as claimed in claim 6 comprising a servo motor for operation of the setting wheel.

8. The folder as claimed in claim 7 wherein the setting wheel is in the form of a bevel wheel which cooperates with a further bevel wheel attached to an output shaft of the servo motor, said servo motor being so arranged that it is perpendicular to the adjustable shaft.

9. The folder as claimed in claim 1 wherein the bridge drive is provided with an indicating means able to be synchronously adjusted with it.

10. The folder as claimed in claim 1 wherein the collect cylinder also comprises two coaxial fitting carriers able to be rotated in relation to each other and having means for driving them at the same speed of rotation, such fitting carriers being provided with such tucker blades and paper gripping pins and, in the other case, grippers and knife boxes and being provided with coaxial drive wheels which are connected drivingly together by means of an adjustable bridge drive, the drive wheel of the fitting carrier with the tucker blades cooperating with the toothed ring having the larger diameter of the fitting carrier with the folding jaws and the other drive wheel cooperates with a drive wheel of a cutting cylinder set on the collect cylinder.

11. The folder as claimed in claim 1 wherein the bridge drive comprises two pinions rigidly connected together which are able to be adjusted using the shaft mounting them in the axial direction in relation to the drive wheels which are in geared mesh therewith.

12. The folder as claimed in claim 1 wherein the shaft mounting the pinions is able to be locked.

13. The folder as claimed in claim 3 wherein the drive wheel driving the fitting carrier with the folding jaws comprises two toothed rings with different diameters.

14. The folder as claimed in claim 4 wherein the toothed ring, which is in the form of a laterally mounted ring, with the smaller diameter corresponding to the diameter of the other drive wheel is in mesh with the pinion and the toothed ring having the greater diameter is in mesh with the drive wheel joined with the collect cylinder.

15. The folder as claimed in claim 11 wherein said two pinions rigidly connected with each other are oppositely helically toothed.

16. The folder as claimed in claim 12 comprising a frictional clamping device for locking said shaft mounted said pinions.

* * * * *